US011501940B2

(12) United States Patent
Orban et al.

(10) Patent No.: US 11,501,940 B2
(45) Date of Patent: Nov. 15, 2022

(54) ELECTROMAGNETIC ACTUATOR AND ELECTRICAL SWITCHING UNIT INCLUDING THIS ACTUATOR

(71) Applicant: Schneider Electric Industries SAS, Rueil Malmaison (FR)

(72) Inventors: Remy Orban, Saint Martin d'Uriage (FR); Olivier Theron, Montbonnot-Saint-Martin (FR); Sebastien Buffat, Tullins (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 300 days.

(21) Appl. No.: 16/456,720

(22) Filed: Jun. 28, 2019

(65) Prior Publication Data

US 2020/0043688 A1 Feb. 6, 2020

(30) Foreign Application Priority Data

Aug. 1, 2018 (FR) ..... 18 57209

(51) Int. Cl.
*H01H 50/64* (2006.01)
*H01H 50/20* (2006.01)
(Continued)

(52) U.S. Cl.
CPC ..... *H01H 50/641* (2013.01); *H01H 50/20* (2013.01); *H01H 50/44* (2013.01); *H01H 51/01* (2013.01)

(58) Field of Classification Search
CPC ..... H01F 7/1615; H01F 2007/086; H01F 2007/1676; H01F 41/0246; H01F 7/1646;
(Continued)

(56) References Cited

U.S. PATENT DOCUMENTS 2,539,547 A 1/1951 Mossman et al.
4,928,888 A * 5/1990 Ricco ..... F02M 63/0021 239/533.8
(Continued)

FOREIGN PATENT DOCUMENTS

CN 102272865 A * 12/2011 ..... H01F 7/16
DE 197 09 089 A1 9/1998
(Continued)

OTHER PUBLICATIONS

French Preliminary Search Report dated Apr. 12, 2019 in French Application 18 57209, filed on Aug. 1, 2018 (with English Translation of Categories of Cited Documents & Written Opinion).

*Primary Examiner* — Bernard Rojas
(74) *Attorney, Agent, or Firm* — Oblon, McClelland, Maier & Neustadt, L.L.P.

(57) ABSTRACT

An electromagnetic actuator includes a fixed body, a moving part forming a magnetic core of the actuator and being movable in translation with respect to the fixed body between a retracted position and a deployed position, a magnetic piece forming a permanent magnet adjusted to generate a first magnetic force holding the moving part in the retracted position, and a coil adjusted to engender a second magnetic force opposed to the first magnetic force when the coil is supplied with an electrical excitation current. The moving part includes one or more notches formed in a body of the moving part.

10 Claims, 2 Drawing Sheets

(51) Int. Cl.
*H01H 50/44* (2006.01)
*H01H 51/01* (2006.01)

(58) Field of Classification Search
CPC ..... H01H 51/01; H01H 3/28; H01H 50/20; H01H 50/44; H01H 50/641; H01H 71/322; H01H 71/321; H01H 71/24
See application file for complete search history.

(56) References Cited

U.S. PATENT DOCUMENTS

| | | | | |
|---|---|---|---|---|
| 2001/0030307 | A1* | 10/2001 | Bergstrom | H01F 7/081 251/129.09 |
| 2007/0175436 | A1* | 8/2007 | Grundl | F02M 51/0653 123/294 |
| 2010/0176902 | A1 | 7/2010 | Volkmar | |
| 2013/0009081 | A1* | 1/2013 | Karl | B60T 8/3615 251/129.01 |
| 2018/0195482 | A1 | 7/2018 | Zhang et al. | |
| 2018/0299026 | A1* | 10/2018 | Hamann | F16K 31/0651 |
| 2019/0323623 | A1* | 10/2019 | Mahajan | F16K 1/34 |
| 2020/0312597 | A1* | 10/2020 | Ito | H01H 50/546 |
| 2020/0336033 | A1* | 10/2020 | Takahashi | H02P 21/22 |
| 2021/0083536 | A1* | 3/2021 | Baba | H02K 1/2773 |

FOREIGN PATENT DOCUMENTS

| | | | |
|---|---|---|---|
| DE | 10 2007 028 203 | B3 | 12/2008 |
| FR | 2 893 445 | A1 | 5/2007 |
| WO | WO 2017/041925 | A1 | 3/2017 |

* cited by examiner

ELECTROMAGNETIC ACTUATOR AND ELECTRICAL SWITCHING UNIT INCLUDING THIS ACTUATOR

The present invention relates to an electromagnetic actuator and an electrical switching device including this actuator.

The electrical switching devices, such as the circuit breakers, used in installations for distributing electricity, generally include an electromagnetic actuator whose function is to switch the electrical device from an electrically closed state to an electrically open state in response to a control signal. For example, a moving part of the actuator is coupled to a switching mechanism of the electrical device. The actuator allows in particular the distribution of electricity to be interrupted in the event of detection of an electrical fault.

FR-2893445-B1 discloses a known electromagnetic actuator including a fixed body, a moving part, and an electrical excitation magnetic circuit adjusted to set the moving part in motion. The magnetic circuit includes a permanent magnet and an excitation coil powered by a control signal.

Such actuators must meet numerous requirements. They must be compact and have small dimensions so as to be able easily to be integrated inside the switching devices. They must react rapidly in response to the control signal, in particular in the event of an electrical fault. They must be reliable and not trip unintentionally, as this would affect the functioning of the switching device. In particular, they must not trip when exposed to parasitic magnetic fields generated during short circuits downstream of the switching device. They must also be able to function within switching devices in which the control signal is supplied from an embedded energy reserve.

It is these disadvantages that the invention intends more particularly to remedy by proposing an electromagnetic actuator whose functioning is improved.

To do this, the invention relates to an electromagnetic actuator including:

- a fixed body;
- a moving part forming a magnetic core of the actuator and being movable in translation with respect to the fixed body between a retracted position and a deployed position;
- a magnetic piece forming a permanent magnet adjusted to generate a first magnetic force holding the moving part in the retracted position;
- a coil adjusted to engender a second magnetic force opposed to the first magnetic force when the coil is supplied with an electrical excitation current.

The moving part includes one or more notches formed in a body of the moving part.

Thanks to the invention, the notches arranged in the moving part make it possible to limit the eddy currents that appear in the moving part during excitation of the coil. Furthermore, the notches make it possible to change the inductance of the magnetic circuit and therefore to reduce the amount of energy needed to control the tripping of the actuator.

According to advantageous but not obligatory aspects of the invention, such an actuator can incorporate one or more of the following characteristics, taken in isolation or according to any technically admissible combination:

- The moving part is made in iron-silicon alloy.
- The mass concentration of silicon in the alloy is greater than or equal to 2% and less than or equal to 6.5%, preferably greater than or equal to 2.5% and less than or equal to 3.5%.

- The moving part is manufactured according to a metal injection moulding method.
- Each notch is disposed radially with respect to the centre of the moving part.
- The number of notches is between 1 and 10, preferably 4.
- The angle between the opposite edges of a notch is greater than or equal to 5° and less than or equal to 50°.
- The radius of the moving part is greater than or equal to 3 mm and less than or equal to 10 mm, and the length of the radial notches is greater than or equal to 30% of the radius and less than or equal to 90% of the radius.
- The notches are disposed either side of a central geometric plane of the magnetic piece and are aligned perpendicular to this plane.

According to another aspect, the invention relates to an electrical switching device including a switching mechanism and an electromagnetic actuator coupled to the switching mechanism, the electromagnetic actuator being as described previously.

The invention will be better understood and other advantages of same will emerge more clearly in the light of the description that will follow of an embodiment of an electromagnetic actuator, which description is given solely as an example and made with reference to the attached drawings, in which.

Figure 1:
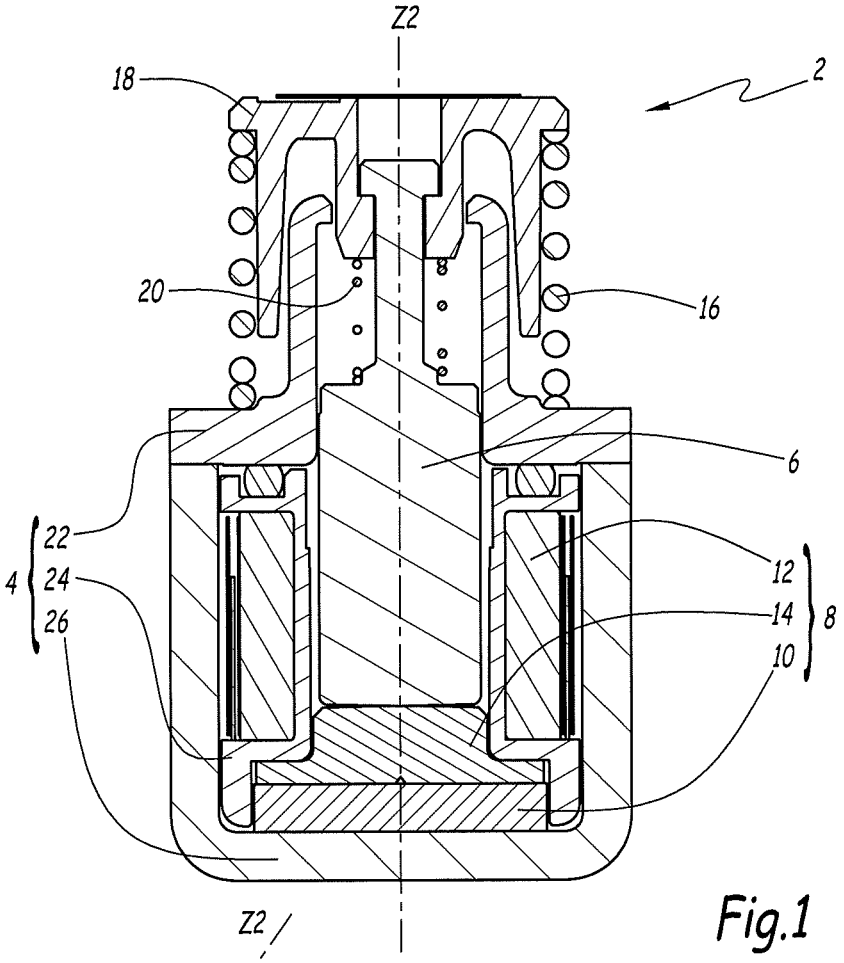
FIG. 1 is a schematic illustration of a sectional view of an electromagnetic actuator according to embodiments of the invention.

FIG. 1 shows an electromagnetic actuator 2 including a fixed body 4 and a moving part 6 that forms a magnetic core of the actuator 2.

The moving part 6 is movable in translation with respect to the fixed body 4 along a longitudinal axis Z2 of the actuator 2 between a deployed position and a retracted position. In the deployed position, also called "tripped position", the moving part 6 is at least partially deployed outside the fixed body 4. In the retracted position, also called "armed position", the moving part 6 is retracted inside the fixed body 4.

The body 4 here forms a casing in the shape of a hollow cylinder centred on the longitudinal axis Z2. The casing ensures guidance in translation of the moving part 6 as it moves between the retracted and deployed positions.

The actuator 2 also includes a magnetic excitation circuit 8, comprising, apart from the moving part 6, a magnetic piece 10 forming a core of the magnetic circuit and which creates a first magnetic force for holding the moving part 6 in the retracted position when the actuator 2 is not excited.

The piece 10 has a flat disc shape centred on the longitudinal axis Z2. When the piece 10 is installed inside the actuator 2, the main sides of the piece 10 are perpendicular to the axis Z2.

According to examples, the piece 10 is made in material having a permanent magnetization, preferably in ferromagnetic material.

The magnetic circuit 8 also includes a coil 12 able to engender a second magnetic force opposed to the first magnetic force when the coil is powered by an electric excitation current. The second magnetic force is opposed to the first magnetic force and allows the release of the moving part 6 as described below.

In the illustrated example, the first force and the second force are directed along the axis Z2. The coil 12 includes for example turns of an electrically conducting wire concentrically wound around the axis Z2.

According to implementation examples, the magnetic circuit 8 also includes a piece 14 for concentrating the magnetic flux. In this example, the piece 14 is in contact with an upper side of the magnetic piece 10 through its lower side. In the retracted position, the moving part 6 is in contact with an upper part of the piece 14.

The actuator also includes an elastic return component 16 mechanically coupled with the moving part 6 and which exerts a return force, tending to move the moving part 6 towards its deployed position. For example, the return component 16 is a spring, in particular a compression coil spring coaxially installed around the axis Z2.

When the actuator 2 is at rest, the first force exerted by the magnetic piece 10 is greater than the return force exerted by the component 16, such that the moving part 6 remains in its retracted position. When the coil 12 is excited by means of an electric power supply, for example in response to a control signal sent to the actuator 2, it generates a magnetic field opposed to that created by the piece 10, thus reducing the resulting magnetic force. The return force exerted by the component 16 then moves the moving part 6 towards its deployed position.

According to examples, the moving part 6 includes a main body of an essentially cylindrical shape and a rectilinear narrow rod-shaped portion that extends longitudinally from an upper end of the main body.

According to the illustrated embodiment, the moving part 6 includes a moving head 18 installed to slide along the rod-shaped portion and coupled with a secondary return component 20, installed in turn on the moving part 6. For example, the component 20 is a coil spring concentric with the axis Z2. The return component 16 bears on one hand on the body 4 and on the other, on the opposite end, on the head 18.

According to an implementation example, the fixed body 4 is formed by assembling at least two parts 22 and 24 concentrically disposed and for example connected together by a seal. The reference 26 designates a base plate that closes the body 4 at its lower end. For example, the magnetic piece 10 is installed on an upper side of the base plate 26. The head 18 extends at the opposite end of the body 4.

For example, the actuator 2 is similar to the actuator described in Patent FR 2 893 445 B1 and functions in a similar manner.

Figure 2:
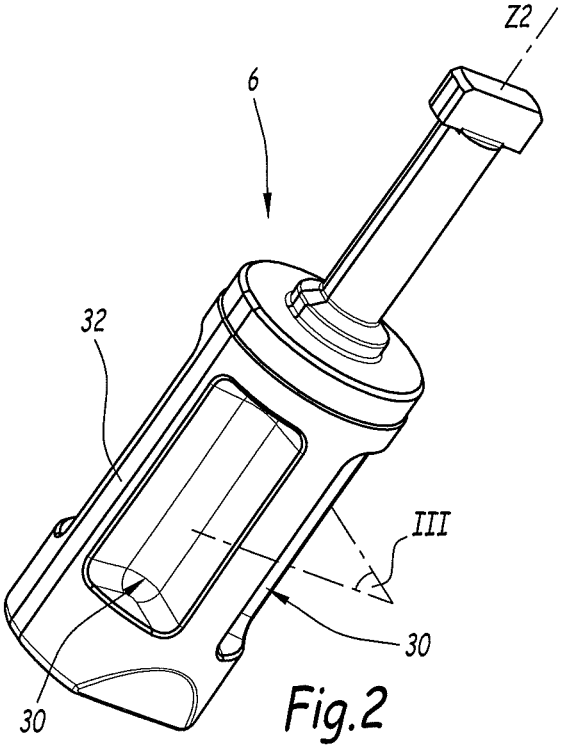
FIG. 2 is a schematic illustration, along a perspective view, of a first embodiment of a moving part of a magnetic excitation circuit of the actuator of FIG. 1.

As illustrated on FIG. 2, the moving part 6 includes one or more notches 30, such as slots or recesses, arranged in the main body of the moving part 6. The notches 30 preferably extend from a peripheral edge 32 of the main body of the moving part 6. According to embodiments, the notches 30 are radial notches, that is to say notches disposed radially with respect to the centre of the moving part 6, that is to say here with respect to the longitudinal axis of the moving part 6. The longitudinal axis of the moving part 6 merges with the axis Z2 when the moving part 6 is installed in the actuator 2. The notches 30 thus extend essentially perpendicular to the peripheral edge 32 of the moving part 6.

For example, each notch 30 extends from the peripheral edge 32 of the moving part 6 towards the centre of the moving part 6 while defining a radial section portion of the moving part 6. "Radial section portion" here means that the notch 30 does not form a complete radial section of the moving part 6, as the notch 30 does not extend completely to the centre of the moving part 6. On the contrary, each notch 30 is terminated towards the centre by an inner end edge 34 that is situated at a non-zero distance from the centre.

Figure 3:
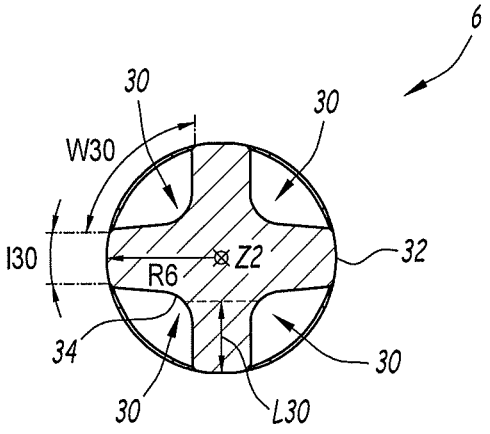
FIG. 3 is a sectional view of the moving part of FIG. 2 in the sectional plane III according to a first embodiment.

On FIG. 3, the reference R6 designates the radius of the moving part 6, measured at the main body of the moving part 6 where the notches 30 are formed. The reference w30 designates the angle between the opposite edges of a notch 30. For example, the angle w30 is measured at the edge 32. The reference $\vartheta$30 designates the width of a notch 30.

According to embodiments, the notches 30 of the moving part 6 are identical.

The notches 30 are preferably regularly spaced with respect to each other, that is to say they are uniformly distributed over the entire perimeter of the moving part 6. In this case, the moving part 6 has a rotational symmetry around the axis Z2 when the moving part 6 is installed inside the actuator 2.

According to embodiments, the number of radial notches 30 is more than or equal to one, and preferably between 1 and 10, and preferably again, between 3 and 10. In the illustrated example, the number of notches 30 is 4.

According to embodiments, the angle w30 of a notch is greater than or equal to 5° and less than or equal to 50°, or the angle w30 is greater than or equal to 20° and less than or equal to 40°. For example, the width $\vartheta$30 is greater than or equal to 5° and smaller than or equal to 20°. Other angle values are possible.

The notches 30 preferably extend in height along the main body of the moving part 6, parallel to the longitudinal axis of the moving part 6. For example, the notches 30 have a height greater than or equal to 20% of the length of the main body of the moving part 6.

According to particular embodiments, the radius R6 of the moving part 6 is preferably greater than or equal to 3 mm and less than or equal to 10 mm.

For example, the length L30 of the radial notches is greater than or equal to 30% of the radius R6 and less than or equal to 90% of the radius R6, and preferably greater than or equal to 40% of the radius R6 and less than or equal to 70% of the radius R6.

In practice, the precise values of the number and dimensions of the slots 30 are optimized according to the applications, and in particular to the performance expected of the actuator 2. According to examples, it is preferable to increase the perimeter of the moving part 6, at the same time keeping a sufficiently large section w30 so that the first magnetic force is sufficient to ensure satisfactory functioning of the actuator 2.

For example, according to embodiments, the ratio of the length of the perimeter of the moving part 6 to the perimeter of a disc of the same radius without notches 30 is greater than or equal to 1.5 and preferably greater than or equal to 2, and preferably again, greater than or equal to 5.

According to variants, not illustrated, each notch 30 has an oblong shape whose side edges are parallel to each other. Each notch 30 thus has a quadrilateral shape, for example a rectangular shape. In this case, the width $\vartheta$30 is the same whether measured at the edge 34 of the moving part 6 or at the edge 32 of the part.

When the coil 12 is excited to control the actuator 2, it creates a magnetic flux aligned along the axis Z2. This magnetic flux engenders eddy currents inside the moving part 6, which causes a loss of energy. These eddy currents generally circulate in the plane of the moving part 6 perpendicular to the direction of the magnetic flux, along the peripheral edge 32. The disposition of the notches 30 tangential to the magnetic flux created by the coil 12 makes it possible to increase the length of the equivalent path travelled by the eddy currents, which impedes their circulation and reduces energy losses.

Reducing the energy losses due to the eddy currents makes it possible to reduce the amount of energy needed to power the coil 12. This is advantageous when the excitation of the actuator 2 inside the electrical device is done by using a battery or an energy reserve whose storage capacity is limited.

Furthermore, the choice of the number and dimensions of the notches 30 makes it possible to change the reluctance of the moving part 6, which makes it possible to optimize the inductance value of the moving part 6 and therefore to reduce the amount of energy needed to trip the actuator 2.

Finally, the notches 30 reduce the weight of the moving part 6. The moving part 6 is thus easier to move. The response time of the actuator 2 is therefore reduced.

According to advantageous embodiments, the moving part 6 is made in iron-silicon alloy.

The mass concentration of silicon in the iron-silicon alloy is preferably greater than or equal to 2% and less than or equal to 6.5%, preferably greater than or equal to 2.5% and less than or equal to 3.5%.

According to particularly advantageous embodiments, the moving part 6 is manufactured by a metal injection moulding method.

The use of iron-silicon alloy makes it possible to obtain magnetic performance values close to those of pure iron, in particular in terms of saturation induction and magnetic permeability, at the same time having an electrical resistivity at least two or three times greater than that of pure iron, which makes it possible to limit the energy losses due to eddy currents when the second magnetic force is applied on the piece 10.

The manufacture of the moving part 6 according to a metal injection moulding method makes it possible to manufacture the moving part 6 in an iron-silicon alloy more easily than with the known forming techniques, for example by machining or turning, which do not give satisfactory results with iron-silicon alloy, in particular for manufacturing small parts, as is the case with the moving part 6.

Figure 4:
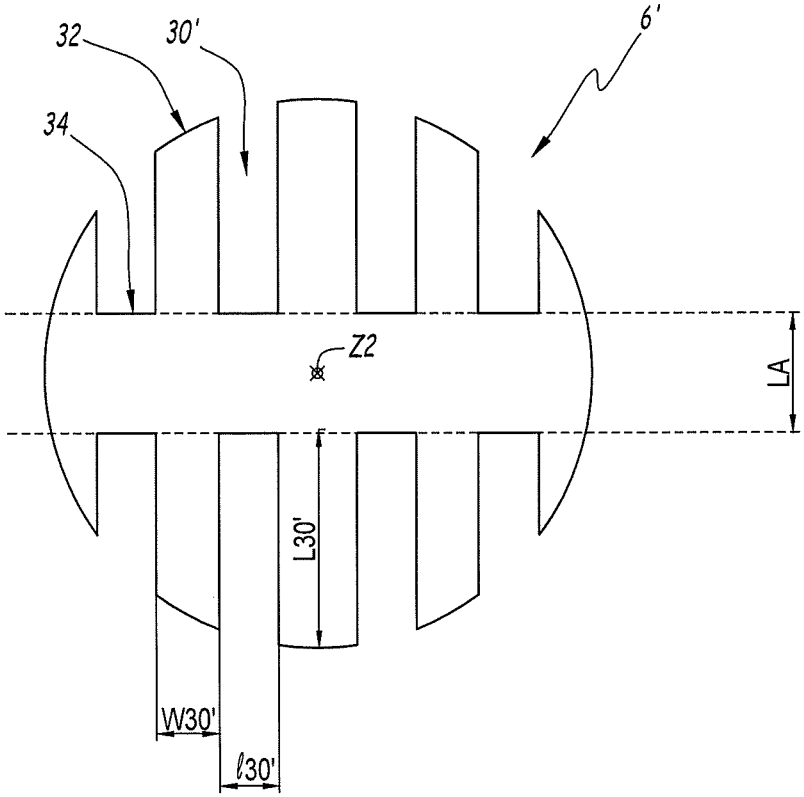
FIG. 4 is a sectional view of an alternative embodiment of the actuator of FIGS. 2 and 3.

FIG. 4 shows a moving part 6' corresponding to another embodiment of the moving part 6. The elements of the moving part 6' that are similar to the moving part 6 have the same references with the addition of the symbol' and are not described in detail, insofar as the above description can be transposed to them. The moving part 6' is able in particular to be integrated inside the actuator 2 in place of the moving part 6.

The moving part 6' differs in particular from the moving part 6 in that the notches 30' of the moving part 6' are not radially oriented. On the contrary, the notches 30' here are disposed either side of a central geometric plane of the moving part 6' and are aligned perpendicular to this plane along parallel directions. The central plane is perpendicular to the sectional plane illustrating the moving part 6' on FIG. 4 and therefore parallel to the axis Z2.

A first group of notches 30' is thus disposed on one side of the central plane and a second group of notches 30' is disposed on the other side of the central plane.

The number of notches 30' is preferably the same in each of the first and second groups. For example, the central plane is a plane of symmetry of the moving part 6'.

According to embodiments, the number of notches 30' in each of the first and second groups is greater than or equal to 2 and less than or equal to 6. In practice, the number and the dimensions of the notches 30' depends on the method of manufacturing the moving part 6' and in particular on the mould release constraints. In the illustrated example, each of the first and second groups includes four notches 30'.

For example, the moving part 6' is manufactured in the same material as the moving part 6, and following a manufacturing method similar to that of the moving part 6.

The respective inner end edges 34 of the notches 30' situated on the same side of the central plane are preferably aligned and situated at the same distance from the central plane. As a result of the circular shape of the peripheral edge 32, the notches 30' whose inner end edges 34 are aligned along the same axis can in this case have different lengths L30'.

On FIG. 4, the reference "LA" designates the distance between the inner end edges 34 of the notches 30' of the first group and of the second group. The distance LA here is greater than or equal to 5% of the diameter of the moving part 6' and less than or equal to 30% of the diameter of the moving part 6'.

Figure 5:
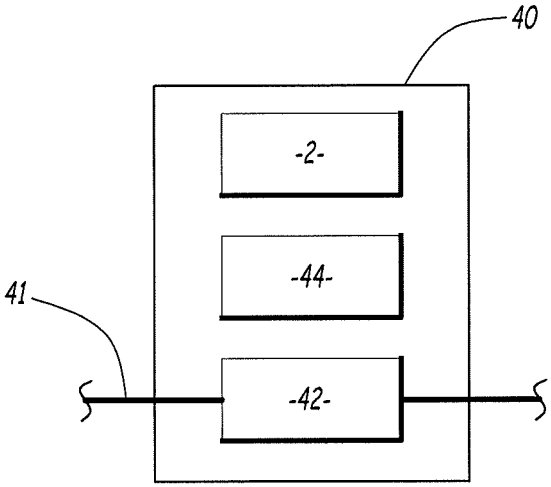
FIG. 5 is a schematic illustration of an electrical device including an electromagnetic actuator according to embodiments of the invention.

In practice, the dimensions of the notches 30', such as the maximum value of the length L30' of the notches 30', the spacing W30' between two consecutive notches 30' and the width $\vartheta$30' of the notches 30' are chosen in a way similar to the moving part 6, in particular with the aim of increasing the length of the equivalent path travelled by the eddy currents and of optimizing the inductance value of the moving part 6'. FIG. 5 shows an electrical switching device 40, such as a circuit breaker, or a contactor, or a relay or any other equivalent device.

The device 40 includes current input/output connection terminals 41, separable electrical contacts 42, a switching mechanism 44 and the actuator 2.

The separable contacts 42 are connected between the terminals 41 and are switchable between an open state and a closed state so as respectively to prevent or authorize the circulation of the electric current, under the action of the switching mechanism 44.

The actuator 2 is coupled to the switching mechanism 44 so as to trip the opening of the separable contacts 42, for example in response to a control signal supplied by a tripping device or by a control unit outside the device 40.

The embodiments and the variants envisaged above can be combined together so as to generate new embodiments.

The invention claimed is:

1. An electromagnetic actuator, comprising:

a fixed body;

a moving part configured to form a magnetic core of the actuator and to move with respect to the fixed body between a retracted position and a deployed position, the moving part having a circular cross-section and one or more notches, the one or more notches not being radial and having a constant width;

a magnetic piece configured to form a permanent magnet that generates a first magnetic force to hold the moving part in the retracted position; and a coil configured to generate a second magnetic force opposed to the first magnetic force when the coil is supplied with an electrical excitation current.

2. The electromagnetic actuator according to claim 1, wherein the moving part is made of an iron-silicon alloy.

3. The electromagnetic actuator according to claim 2, wherein a mass concentration of silicon in the iron-silicon alloy is greater than or equal to 2% and less than or equal to 6.5%.

4. The electromagnetic actuator according to claim 2, wherein the moving part is manufactured according to a metal injection moulding method.

5. The electromagnetic actuator according to claim 1, wherein the one or more notches include between 1 and 10 notches.

6. The electromagnetic actuator according to claim 1, wherein a radius of the moving part is greater than or equal to 3 mm and less than or equal to 10 mm, and a length of the one or more notches is greater than or equal to 30% of the radius and less than or equal to 90% of the radius.

7. The electromagnetic actuator according to claim 1, wherein the one or more notches are disposed either side of a central geometric plane of the magnetic piece and are aligned perpendicular to the central geometric plane.

8. An electrical switching device including a switching mechanism and an electromagnetic actuator coupled to the switching mechanism, wherein the electromagnetic actuator is according to claim 1.

9. The electromagnetic actuator according to claim 3, wherein, the mass concentration of silicon in the iron-silicon alloy is greater than or equal to 2.5% and less than or equal to 3.5%.

10. The electromagnetic actuator according to claim 5, wherein the one or more notches include 4 notches.

* * * * *